US008430390B2

(12) United States Patent
Oosterhoff et al.

(10) Patent No.: US 8,430,390 B2
(45) Date of Patent: Apr. 30, 2013

(54) GATHERING POSTAL ITEMS

(75) Inventors: Hans Oosterhoff, Hoogeveen (NL); Erik Jouke Bijl, Groningen (NL); Herman Sytema, Terhorne (NL)

(73) Assignee: Neopost Technologies, Bagneux (FR)

( * ) Notice: Subject to any disclaimer, the term of this patent is extended or adjusted under 35 U.S.C. 154(b) by 304 days.

(21) Appl. No.: 12/417,971

(22) Filed: Apr. 3, 2009

(65) Prior Publication Data

US 2009/0250862 A1 Oct. 8, 2009

(30) Foreign Application Priority Data

Apr. 3, 2008 (EP) ..... 08154033

(51) Int. Cl.
*B65H 5/22* (2006.01)

(52) U.S. Cl.
USPC ..... 271/3.18; 271/270; 271/277

(58) Field of Classification Search ..... 271/270, 271/277, 3.18
See application file for complete search history.

(56) References Cited

U.S. PATENT DOCUMENTS

| | | | | |
|---|---|---|---|---|
| 4,946,151 | A | 8/1990 | Liebert | |
| 4,993,702 | A * | 2/1991 | Jackson | 271/270 |
| 5,669,604 | A * | 9/1997 | Hansen | 271/265.01 |
| 6,109,605 | A * | 8/2000 | Hirota et al. | 271/186 |

FOREIGN PATENT DOCUMENTS

| | | | |
|---|---|---|---|
| DE | 1 217 402 | B | 5/1966 |
| EP | 0 867 394 | A1 | 9/1998 |
| EP | 1 167 259 | A2 | 1/2002 |
| FR | 2 644 443 | A1 | 9/1990 |
| GB | 2 168 687 | A | 6/1986 |

* cited by examiner

*Primary Examiner* — Stefanos Karmis
*Assistant Examiner* — Howard Sanders
(74) *Attorney, Agent, or Firm* — Sughrue Mion, PLLC

(57) ABSTRACT

Apparatus for gathering postal items having a postal item feeding path for feeding postal items at a speed of transport and a postal item gripper for gripping and subsequently releasing postal items. The gripper is circulatable in a sense of circulation along a circulation path downstream of the feeding path. Each time prior to gripping of one of the postal items by the gripper, at least the speed of transport of the gripper is temporarily reduced to a reduced speed of transport or the speed of transport of the postal item along the feeding path is temporarily increased to an increased speed of transport. A method for gathering postal items is also described.

6 Claims, 2 Drawing Sheets

GATHERING POSTAL ITEMS

FIELD AND BACKGROUND OF THE INVENTION

The invention relates to an apparatus for gathering postal items and to a method for gathering postal items.

From U.S. Pat. No. 5,156,393 an apparatus and a method for gathering postal items are known, which are specifically intended for processing banknotes. In a starting position, a circulatable endless belt of the apparatus carrying flaps is stationary. The belt is stopped twice with each revolution of the belt, when the belt is provided with two flaps. A beam path of a photo-cell comprising a photo-diode and a photo-transistor is broken when a banknote has been inserted to a sufficient extent in between the belt and one of the flaps carried by the belt. When this beam path is broken, a signal is sent to a drive motor for starting the belt. The drive motor then rotates the belt until the flap reaches the position previously occupied by the other flap. Subsequently, the procedure is repeated and the next banknote is inserted, and so on.

A drawback of this apparatus is that repeatedly stopping and restarting of the endless belt causes wear of the drive system, entails a high energy consumption, causes important noise emissions and reduces the capacity of the apparatus, in particular if the belt would be dimensioned more heavily for gripping items larger than banknotes, such as many postal items.

SUMMARY OF THE INVENTION

It is an object of the present invention to provide an apparatus for gathering postal items, such as paper, envelopes or other sheet-like objects, in which the drive structure is strained to a lesser extent, which can achieve a higher capacity, consumes less energy, emits less noise and/or is more durable and which is more suitable for processing larger items than banknotes. According to the invention, this object is achieved by providing an apparatus for gathering postal items, including:

a postal item feeding path for feeding postal items at a speed of transport;

at least one postal item gripper having jaws for gripping postal items between the jaws, the postal item gripper being circulatable in a sense of circulation along a circulation path at a speed of transport, a receiving section of the circulation path extending along a downstream end of the postal item feeding path;

at least one drive for driving displacement of postal items along the postal item feeding path and the circulation of the postal item gripper, such that the postal items fed along the postal item feeding path are fed to and gripped by the at least one gripper;

a postal item collector for receiving the postal items from the at least one gripper each time when the gripper holding one of the postal items passes the collector and releases that one of the postal items, the postal item collector being located along a delivery section of the circulation path, the delivery section being spaced in the sense of circulation from the receiving section of the circulation path; and a collation holder for receiving and holding the released postal items in a collated configuration;

wherein the at least one drive is arranged for, each time prior to gripping of one of the postal items by the gripper, at least:

temporarily reducing the speed of transport of the gripper to a reduced speed of transport, or temporarily increasing the speed of transport of the postal item along the feeding path to an increased speed of transport.

Also according to the invention, this object is achieved by providing a method for gathering postal items, comprising, for each of a plurality of postal items:

circulating at least one gripper at a speed of transport along a circulation path having a receiving section in which the gripper passes along a downstream end of a postal item feeding path;

feeding the postal item along the postal item feeding path at a speed of transport such that a leading edge of the postal item is gripped between jaws of the at least one gripper after it has reached the circulation path;

releasing the postal item from the gripper in a delivery section of the circulation path, the delivery section being spaced in the sense of circulation from the receiving section of the circulation path; and each time prior to the gripping of the postal item, at least:

temporarily reducing the speed of transport of the gripper to a reduced speed of transport, or temporarily increasing the speed of transport of the postal item along the feeding path to an increased speed of transport;

wherein the released postal item is collated to form a collated set.

By causing a temporary difference between the speed of transport of the feeding path and the speed of transport of the circulation path, while maintaining movement of both the gripper along the circulation path and of the postal item along the feeding path, processing of postal items, and in particular a reliable hand-over from the feeding path to the gripper can be carried out at higher production rate, while less energy is required, less noise is emitted and/or less wear is caused.

Particular elaborations and embodiments of the invention are set forth in the dependent claims.

Further features, effects and details of the invention appear from the detailed description and the drawings.

DETAILED DESCRIPTION

Figure 1:
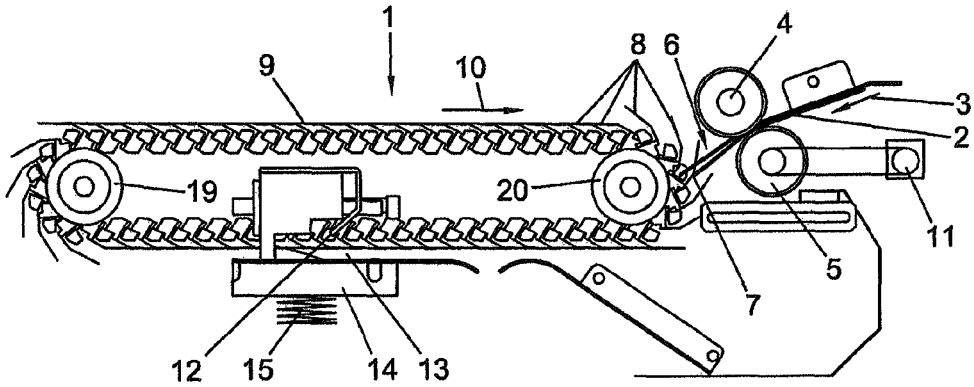
FIG. 1 is a schematic side view of an example of an apparatus according to the invention with a first postal item in a feeding path.

In FIG. 1, an apparatus 1 for gathering postal items according to the invention is shown in an operating condition in which a postal item 2 is transported along a postal item feeding path 3. A nip between a set of feeding rollers 4, 5 constitutes a downstream end 6 of the feeding path 3. The feeding rollers 4, 5 feed a leading edge 7 of the postal item 2 towards one of a plurality of grippers 8 mounted on a collating belt 9 carrying grippers 8 (only some of the grippers 8 are designated by reference numerals). The grippers 8 can be circulated along a circulation path 10. The feeding rollers 4, 5 and the collating belt 9 are driven by a drive motor 11 coupled thereto via a transmission that allows to change the transport speed of the grippers 8 separately from the transport speed of the feeding path 3. A receiving section of the circulation path 10 extends along the downstream end of the feeding path 3. Downstream in a circulation sense of the receiving section, a collector 12 for collecting postal items 2 released from the grippers 8 is arranged along a delivery section of the circulation path 10. In operation, postal items collected from the grippers are gathered to form a stack 13. A stack holder 14 holding the stack 13 is supported by a spring 15 (shown schematically) which allows the stack holder 14 to descend as the height of the stack 13 increases with the number of collated postal items 2.

Figure 2:
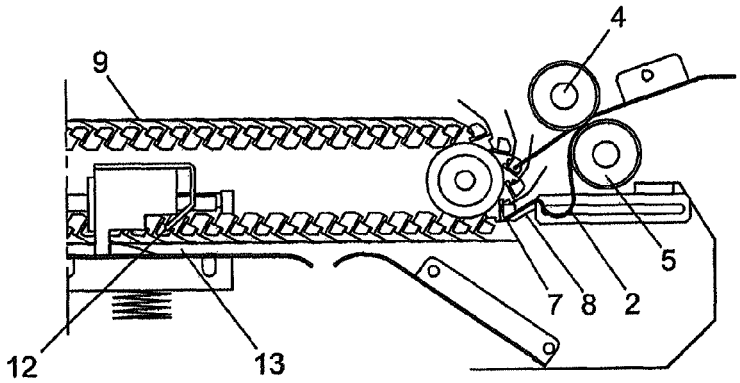
FIG. 2 is a schematic side view of the apparatus shown in FIG. 1 with a leading edge of the first postal item gripped by a gripper.

In the present example, the feeding rollers 4, 5 and the collating belt 9 are initially driven at speeds such that the transport speed of the grippers 8 is equal to the transport speed of postal items in the feeding path 3. Prior to gripping of a postal item 2 by a gripper 8, the speed of transport of the feeding rollers 4, 5 is increased temporarily, so that the postal item transported thereby is temporarily transported at a higher speed than the grippers 8, thus driving the leading edge 7 of the postal item 2 between jaws of one of the grippers 8 so that the leading edge of the postal item 2 is gripped by the gripper 8. In the present example, the jaws of the gripper 8 move apart each time when the gripper 8 passes one of two curves of the circulation path 10 and move together, thereby gripping a postal item, if any, that has been brought between the jaws, when the gripper 8 passes into a straight section of the circulation path 10. After the gripper 8 has gripped the postal item 2, the feeding path 3 may for a brief time interval still be driven to transport the trailing end of the postal item 2 at the increased speed. As is shown in FIG. 2, this temporary difference in speed between the leading end of the postal item 2 and the trailing end of the postal item 2 is accommodated by allowing the postal item 2 to buckle as the feeding rollers 4, 5 still drive the trailing end of the postal item at a transport speed higher than the transport speed of the leading end. Subsequently, the feeding path 3 is again driven at such a speed at which the transport speed of the grippers 8 is equal to the transport speed of postal items in the feeding path 3.

The trailing end of the postal item 2 is released from the feeding rollers 4, 5 only after the leading end of the postal item 2 has been gripped by the gripper 8. Thus, the postal item 2 is continuously engaged, either by the feeding path 3 or the gripper 8.

When relatively short postal items, such as the postal item 2, are processed, the speed of transport of the feeding rollers 4, 5 is reduced to its former speed after the trailing end of the postal item 2 is released by the feeding rollers 4, 5. However, the time, during which the feeding rollers 4, 5 rotate at an increased speed, is chosen such that the duration at which a postal item is transported at an increased speed is maximized for postal items over a given length as will be illustrated for a longer postal item 16 (FIGS. 3-6). This results in a maximum difference between a transport distance over which the gripper 8 has been displaced and the transport distance covered by the trailing end of the postal item 2 driven by the feeding rollers 4, 5 while the postal item is engaged by both the gripper 8 and the feeding rollers 4, 5. This maximum difference determines the maximum extent to which postal items are caused to buckle during hand-over from the feeding path 3 to the gripper 8.

Figure 3:
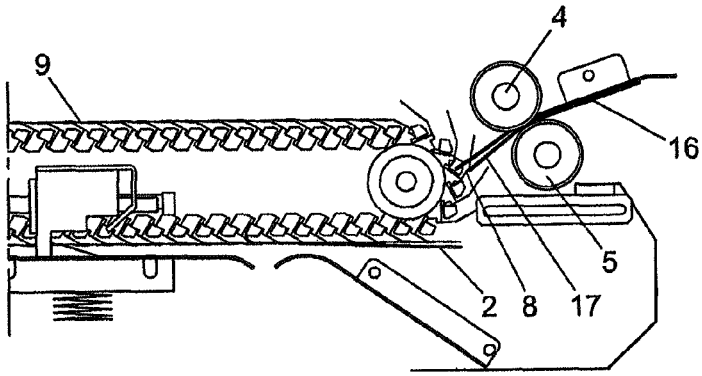
FIG. 3 is a schematic side view of the apparatus shown in FIGS. 1 and 2 with the first postal item transported along a circulation path and a second postal item in the feeding path.
Figure 4:
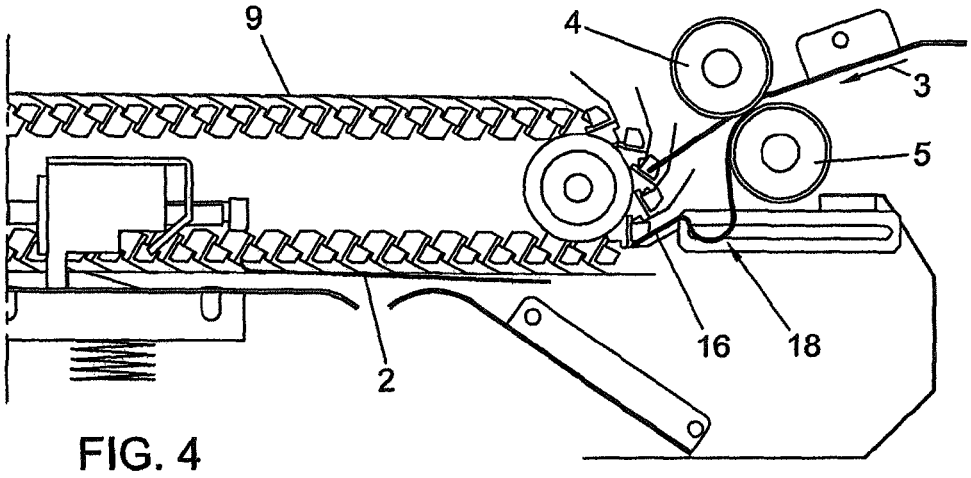
FIG. 4 is a schematic side view of the apparatus shown in FIGS. 1-3 with the first postal item transported further along the circulation path and a second postal item gripped by a second gripper.
Figure 5:
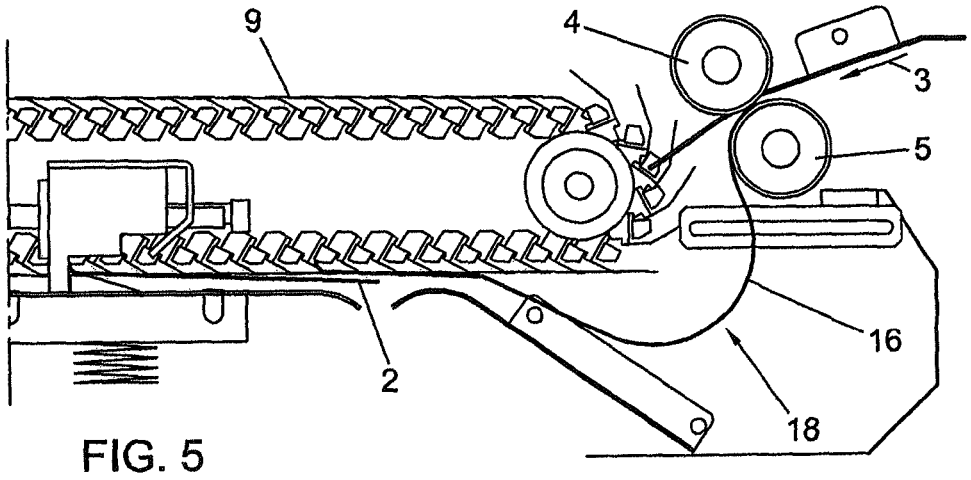
FIG. 5 is a schematic side view of the apparatus shown in FIGS. 1-4 with the first postal item collected by a postal item collector and the second postal item transported along the circulation path.

The postal item 2 held by the gripper 8 is then transported further by the collating belt 9, as is shown in FIGS. 3 and 4. In FIG. 5 the postal item 2 is released from the gripper 8 by the collector 12 and gathered on the stack 13.

Figure 6:
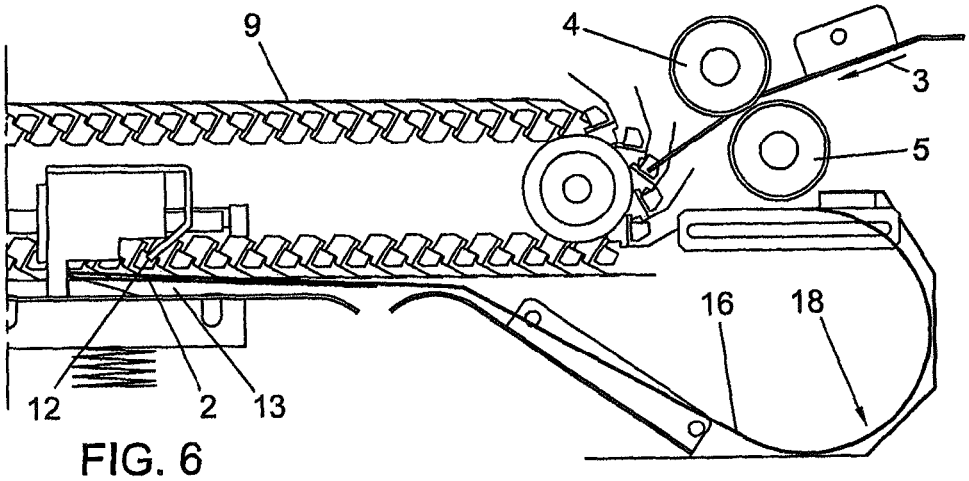
FIG. 6 is a schematic side view of the apparatus shown in FIGS. 1-5 with both the first and second postal item in the postal item collector.

In FIG. 3, a next postal item 16, which is longer than the first postal item 2, is fed by the feeding rollers 4, 5. Again, prior to engagement of the postal item 16 by one of the grippers 8 passing the downstream end 6 of the feeding path 3, the speed of transport of the feeding rollers 4, 5 is increased temporarily to a higher speed of transport than the speed of transport of the circulating belt 9, thus urging the leading edge 17 of the second postal 16 item into the reach of one of the grippers 8. The gripper 8 engages the second postal item 16, which then starts to buckle as the feeding rollers 4, 5 still drive the trailing end of the postal item 16 at an increased speed. Due to the length of the second postal item 16 a larger buckle 18 is created, as can be seen in FIGS. 4, 5 and 6, but it is limited since the time interval during which the feeding rollers 4, 5 drive at an increased speed is shorter than the duration of the time interval during which the postal item 16 is engaged by both the gripper 8 and the feeding path 3. Thus, even if a longer postal item would be processed, the buckle 18 would not be larger than the buckle created in the second postal item 16.

When the speed of transport of the feeding rollers 4, 5 is decreased to its former speed, the buckling stops. The second postal item 16 held by the gripper 8 is then transported further by the collating belt 9 until it is released from the gripper 8 by the collector 12 and gathered with the first postal item 2 so as to form a stack 13 (see FIGS. 5 and 6).

In the present example, a plurality of grippers 8 is distributed over the circulation path 10 in the sense of circulation direction. To limit the number of occasions at which the speed of transport of the feeding path 3 is increased, the temporary increase of the speed of transport of the postal item along the feeding path 3 is preferably initiated selectively in response to detection of a postal item in the feeding path 3 only.

Furthermore, the grippers 8 may circulate along two or more feeding paths (not shown) that converge with the circulation path in various positions mutually spaced in the circulation sense. Preferably, when two or more feeding paths each contain a postal item, a postal item from the first feeding path is fed to a first one of the grippers and a postal item from the second feeding path is simultaneously fed to a second one of the grippers. Then, the speeds of the feeding paths can be temporarily increased simultaneously, which can be controlled in a simpler manner than increasing the speeds of transport of the feeding paths individually. Simultaneously feeding postal items to the grippers is specifically advantageous if the temporary speed difference is achieved by temporarily reducing the speed of transport of the grippers, because the speed of transport then needs to be reduced only once for handing over a plurality of postal items from several feeding paths to the grippers.

When the postal items form the first and the second feeding path are engaged by the respective grippers, the grippers are transported to a collector placed further downstream. There, the postal items are collected from the circulation path and placed on a stack.

While the invention has been illustrated and described in detail in the drawing and foregoing description, such illustration and description are to be considered illustrative or exemplary and not restrictive; the invention is not limited to the disclosed embodiments. For instance, in the present example, the grippers are constituted by a pair of fingers between which the postal items are gripped, each of the grippers 8 being constituted by two successive fingers, the relative distance between the fingers varying with the curvature of the belt. However, the postal items may also be gripped in another manner, for instance by suction in for instance a suction cup that pulls the postal item against the gripper. It can also be advantageous to provide that the grippers grip postal items while passing through a straight section of the circulation path. To this end for example guide rails may be arranged along the circulation path, which guide rails engage operating arms coupled to one or more of the jaws of the grippers as the grippers pass the guide rail.

Furthermore, in the present example, the postal items are each constituted by a single item. However, one or more of the postal items may be constituted by a plurality of elements, for instance two or more sheets that may be affixed to each other and/or folded or not. Furthermore, in the present example the temporary difference between the speed of transport of the grippers and the speed of transport induced by the feeding path is achieved by temporarily increasing the speed of transport of the feeding path. However, it is also possible to achieve the temporary difference between the speed of transport of the grippers and the speed of transport induced by the feeding path by temporarily reducing the speed of transport of the grippers. A temporary reduction of the speed of transport of the gripper or grippers may also be combined with a temporary reduction of the speed of transport induced by the feeding path. In the example shown in the drawings, the ability to temporarily reduce the transport speed of the grippers 8 could for instance be achieved by coupling the drive 11 via a two or more gear transmission to one of the rollers 19, 20 about which the belt 9 of grippers 8 has been tensioned.

Other variations to the disclosed embodiments can be understood and effected by those skilled in the art in practicing the claimed invention, from a study of the drawings, the disclosure, and the appended claims.

The invention claimed is:

1. A method for gathering postal items, comprising, for each of a plurality of postal items:

circulating at least one gripper at an initial gripper speed of transport along a circulation path having a receiving section in which the gripper passes along a downstream end of a postal item feeding path;

feeding the postal item along the postal item feeding path at an initial postal item speed of transport until a leading edge of the postal item has reached the circulation path and is gripped between jaws of the at least one gripper, wherein, each time from prior to the gripping of the postal item until after the postal item has been gripped, at least:

the speed of transport of the gripper along the circulation path is a reduced speed of transport with regard to the initial gripper speed of transport, or the speed of transport of the postal item along the feeding path is an increased speed of transport with regard to the initial postal item speed of transport;

such that a temporary difference between the speed of transport of the gripper and the speed of transport of the postal item is caused; and subsequently, when said one of the postal items is still gripped by the gripper, transporting said one of the postal items at the initial postal item speed of transport until the postal item is released from the gripper at a postal item collector along a delivery section of the circulation path, the delivery section being spaced in the sense of circulation from the receiving section of the circulation path; and collating the released postal item at the postal item collector to form a collated set.

2. A method according to claim 1, wherein at least the temporary difference between the speed of transport of the gripper and the speed of transport of the postal item is initiated after the gripper has passed the downstream end of the postal item feeding path.

3. A method according to claim 1, wherein, before and after the temporary difference between the speed of transport of the gripper and the speed of transport of the postal item, the speed of transport of the gripper is equal to the speed of transport of the postal item feeding path.

4. A method according to claim 1, wherein a trailing end of the postal item is released from the feeding path after the leading edge of the postal item is gripped by the gripper.

5. A method according to claim 1, wherein a plurality of the grippers distributed in circulation sense over the circulation path are circulated along the circulation path and wherein the temporary difference between the speed of transport of the gripper and the speed of transport of the postal item is selectively initiated in response to detection of a postal item in the feeding path.

6. A method according to claim 1, wherein a plurality of the grippers is distributed in circulation sense over the circulation path and wherein the speeds of transport of the grippers are mutually identical.

* * * * *